US010319551B2

(12) United States Patent
Bruan et al.

(10) Patent No.: US 10,319,551 B2
(45) Date of Patent: Jun. 11, 2019

(54) SEALED FUSE

(71) Applicant: Littelfuse, Inc., Chicago, IL (US)

(72) Inventors: Ped Peterson Bruan, Batangas (PH); Grace Miranda, Lipa (PH); Edwin Aberin, Batangas (PH)

(73) Assignee: LITTELFUSE, INC., Chicago, IL (US)

( * ) Notice: Subject to any disclaimer, the term of this patent is extended or adjusted under 35 U.S.C. 154(b) by 0 days.

(21) Appl. No.: 15/867,053

(22) Filed: Jan. 10, 2018

(65) Prior Publication Data

US 2018/0130626 A1 May 10, 2018

Related U.S. Application Data

(62) Division of application No. 15/291,164, filed on Oct. 12, 2016, now Pat. No. 9,953,791.

(51) Int. Cl.

| | |
|---|---|
| ***H01H 69/02*** | (2006.01) |
| ***H01H 85/00*** | (2006.01) |
| ***H01H 85/157*** | (2006.01) |
| *H01H 85/02* | (2006.01) |
| *H01H 85/041* | (2006.01) |

(52) U.S. Cl.

CPC ..... *H01H 85/0013* (2013.01); *H01H 69/02* (2013.01); *H01H 85/157* (2013.01); *H01H 85/003* (2013.01); *H01H 85/0021* (2013.01); *H01H 2085/0275* (2013.01); *H01H 2085/0412* (2013.01); *H01H 2085/0414* (2013.01); *H01H 2223/002* (2013.01)

(58) Field of Classification Search

CPC ... H01H 2085/0275; H01H 2085/0412; H01H 2085/0414; H01H 85/0013; H01H 85/0021; H01H 85/003; H01H 85/0418; H01H 85/0458; H01H 85/157; H01H 69/02; H01H 2223/002

USPC ..... 337/205

See application file for complete search history.

(56) References Cited

U.S. PATENT DOCUMENTS

| | | | | | |
|---|---|---|---|---|---|
| 3,878,423 | A * | 4/1975 | Hill | H01T 1/14 | 313/231.11 |
| 4,101,860 | A * | 7/1978 | Fister | H01H 85/10 | 337/159 |
| 4,656,453 | A * | 4/1987 | Reeder | H01H 69/02 | 337/236 |
| 4,684,915 | A * | 8/1987 | Knapp, Jr. | H01H 85/38 | 337/273 |
| 4,920,327 | A * | 4/1990 | Arikawa | H01H 85/0411 | 337/231 |
| 5,214,406 | A * | 5/1993 | Reese | H01H 85/0411 | 337/231 |

(Continued)

*Primary Examiner* — Jacob R Crum

(57) ABSTRACT

A sealed fuse in accordance with the present disclosure may include a tubular fuse body, a trench formed in an exterior of the fuse body, and an electrically conductive endcap that fits over an end of the fuse body and is fastened to the fuse body by an electrically conductive material having a lip portion that extends into the trench to provide a barrier that extends between the fuse body and the endcap. In an embodiment, the trench may be formed in an end face of the fuse body and may extend entirely around an opening in the end of the fuse body. In another embodiment, the trench may be formed in an outwardly-facing surface of a sidewall of the fuse body and may extend entirely around the fuse body.

12 Claims, 6 Drawing Sheets

(56) References Cited

U.S. PATENT DOCUMENTS

| | | | | |
|---|---|---|---|---|
| 5,642,090 | A * | 6/1997 | Arikawa | H01H 85/0418 337/186 |
| 5,739,740 | A * | 4/1998 | Stark | H01H 85/143 337/227 |
| 2009/0072943 | A1 * | 3/2009 | Aberin | H01H 69/02 337/186 |
| 2011/0298577 | A1 * | 12/2011 | Enriquez | H01H 85/0418 337/186 |

* cited by examiner

SEALED FUSE

CROSS-REFERENCE TO RELATED APPLICATIONS

This Application claims priority to U.S. patent application Ser. No. 15/291,164, filed Oct. 12, 2016, entitled Sealed Fuse, and incorporated by reference herein in its entirety.

FIELD OF THE DISCLOSURE

The present disclosure relates generally to the field of circuit protection devices, and relates more particularly to a sealed fuse adapted to prevent the ingress of solder during installation of the fuse on a circuit board.

FIELD OF THE DISCLOSURE

Fuses are commonly used as circuit protection devices and are typically installed between a source of electrical power and a component in a circuit that is to be protected. One type of fuse, commonly referred to as a "cartridge fuse" or "tube fuse," includes a tubular, electrically insulating fuse body containing a fusible element that extends between electrically conductive, metallic endcaps that cover opposing longitudinal ends of the fuse body. Upon the occurrence of a specified fault condition, such as an overcurrent condition, the fusible element melts or otherwise separates to interrupt the flow of electrical current between the electrical power source and the protected component.

The endcaps of a fuse are commonly fastened to the ends of a fuse body using solder or electrically conductive adhesive, which also connects the fusible element of the fuse to the endcaps and provides an electrically conductive pathway therebetween. When the fuse is operatively installed, such as on a printed circuit board (PCB), the endcaps may be soldered to respective terminals on the PCB, placing the fuse in electrical communication with various other circuit components (e.g., a source of electrical power and a protected load).

A shortcoming associated with traditional cartridge fuses is that when such a fuse is soldered to a PCB, heat from the soldering process can cause the endcaps of the fuse, as well as solder that fastens the endcaps to the fuse body of the fuse (hereinafter "the endcap solder"), to undergo thermal expansion at a rate greater than that of the fuse body. This is due to a mismatch between the coefficient of thermal expansion of the insulative fuse body and the coefficients of thermal expansion of the conductive endcaps and endcap solder. Thus, the heated endcaps and endcap solder may expand away from the fuse body, resulting in the formation of gaps therebetween. Solder that is being applied to the endcaps during installation of the fuse on a PCB may, in its fluid state, migrate through these gaps and may infiltrate the interior of the fuse body. It has been observed that such infiltration can have deleterious effects on the performance of fuses.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

An exemplary embodiment of a sealed fuse in accordance with the present disclosure may include a tubular fuse body, a trench formed in an exterior of the fuse body, and an electrically conductive endcap that fits over an end of the fuse body and is fastened to the fuse body by an electrically conductive material having a lip portion that extends into the trench to provide a barrier that extends between the fuse body and the endcap. In an embodiment, the trench may be formed in an end face of the fuse body and may extend entirely around an opening in the end of the fuse body. In another embodiment, the trench may be formed in an outwardly-facing surface of a sidewall of the fuse body and may extend entirely around the fuse body.

An exemplary embodiment of a method for manufacturing a sealed fuse in accordance with the present disclosure, may include providing a tubular fuse body having a trench formed in an exterior of the fuse body, and fastening an electrically conductive endcap to an end of the fuse body by an electrically conductive material that forms a lip portion that extends into the trench to provide a barrier that extends between the fuse body and the endcap. In an embodiment, the trench may be formed in an end face of the fuse body and may extend entirely around an opening in the end of the fuse body. In another embodiment, the trench may be formed in an outwardly-facing surface of a sidewall of the fuse body and may extend entirely around the fuse body.

DETAILED DESCRIPTION

Figure 1A:
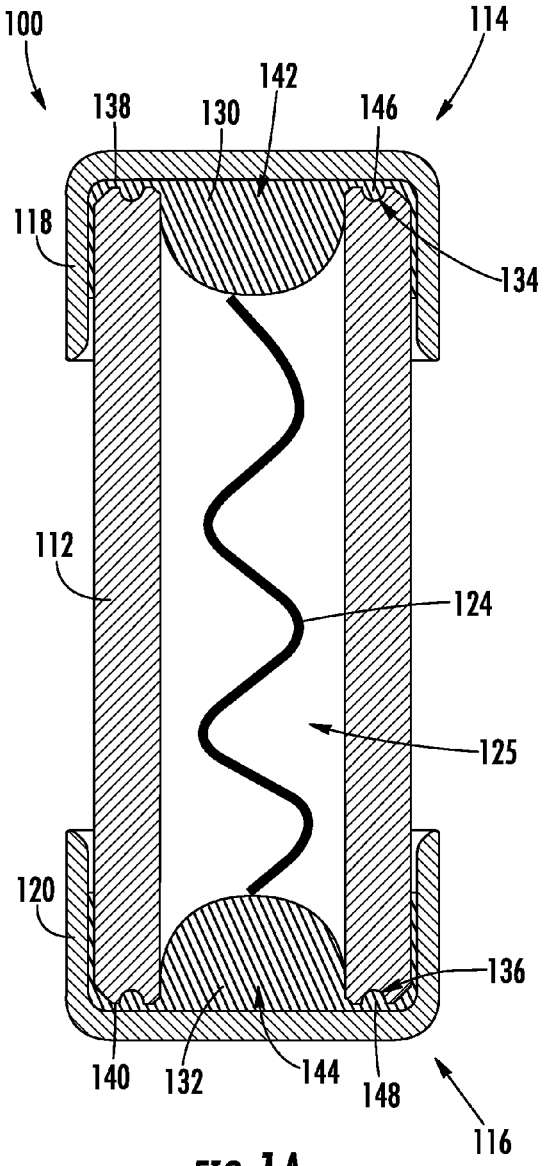
FIG. 1*a* is a cross sectional view illustrating an exemplary sealed fuse in accordance with the present disclosure.

Embodiments of a sealed fuse and a method for manufacturing the same in accordance with the present disclosure will now be described more fully with reference to the accompanying drawings, in which preferred embodiments of the present disclosure are presented. The sealed fuse and the accompanying method of the present disclosure may, however, be embodied in many different forms and should not be construed as being limited to the embodiments set forth herein. Rather, these embodiments are provided so that this disclosure will be thorough and complete, and will fully convey the scope of the sealed fuse and the accompanying method to those skilled in the art. In the drawings, like numbers refer to like elements throughout unless otherwise noted.

Figure 1B:
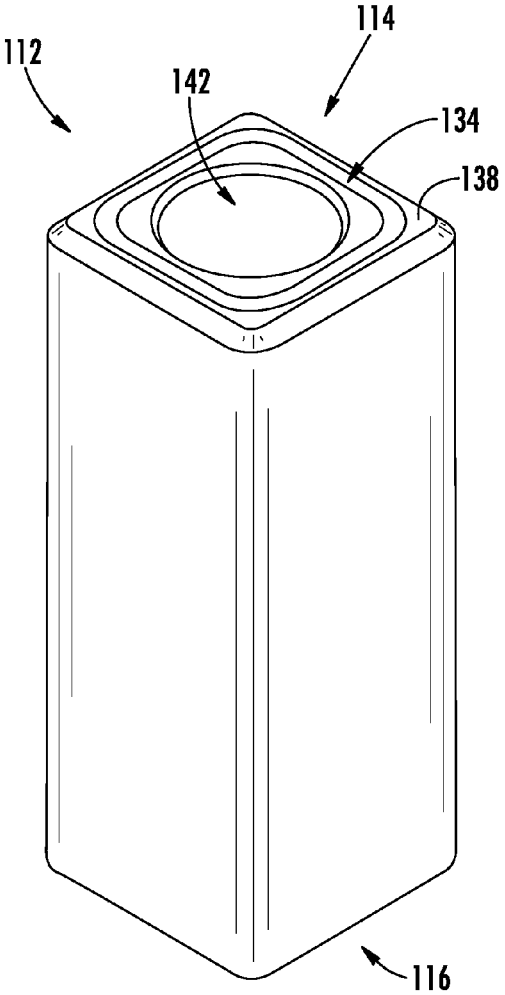
FIG. 1*b* is an isometric view illustrating a fuse body of the sealed fuse shown in FIG. 1*a;*

Referring to FIG. 1*a*, a cross-sectional view of a sealed fuse 100 (hereinafter "the fuse 100") in accordance with an exemplary embodiment of the present disclosure is shown. The fuse 100 may include a tubular fuse body 112 having opposing open ends 114, 116. The fuse body 112 may be a square cylinder (as shown in FIG. 1*b*), but this is not critical. Alternative embodiments of the fuse 100 may have a fuse body that is a round cylinder, an oval cylinder, a triangular cylinder, etc.

A pair of conductive endcaps 118, 120 may fit over the open ends 114, 116 of the fuse body 112, respectively, and may be fastened thereto by solder fillets 130, 132. Alternatively, and as will become apparent below, any type of electrically conductive adhesive that may be applied in a fluid or semi-fluid state and subsequently cured or hardened may be substituted for the solder fillets 130, 132. A fusible element 124 (e.g., a fuse wire) may extend through the hollow interior 125 of the fuse body 112 and may be secured to the endcaps 118, 120 in electrical communication therewith by the solder fillets 130, 132. Alternatively, one or both ends of the fusible element 124 may extend through respective holes in the endcaps 118, 120 and may be soldered to exterior faces of the endcaps 118, 120.

The fuse body 112 of the fuse 100 may be formed of an electrically insulating and preferably heat resistant material, including, but not limited to, ceramic or glass. The endcaps 118, 120 may be formed of an electrically conductive material, including, but not limited to, copper or one of its alloys, and may be plated with nickel or other conductive, corrosion resistant coatings. The fusible element 124 may be formed of an electrically conductive material, including, but not limited to, tin or copper, and may be configured to melt and separate upon the occurrence of a predetermined fault condition, such as an overcurrent condition in which an amount of current exceeding a predefined maximum current flows through the fusible element 124. The fusible element 124 may be any type of fusible element suitable for a desired application, including, but not limited to, a fuse wire, a corrugated strip, a fuse wire wound about an insulating core, etc. In some embodiments, the fusible element 124 may extend diagonally through the hollow interior 25 of the fuse body 112. In some embodiments, the hollow interior 125 of the fuse body 112 may be partially or entirely filled with an arc-quenching material, including, but not limited to, sand, silica, etc.

Referring to FIGS. 1*a* and 1*b*, the fuse body 112 may include channels or trenches 134, 136 formed in longitudinal end faces 138, 140 thereof, respectively. The trenches 134, 136 may be continuous (i.e., without termini) and may entirely surround openings 142, 144 in the respective open ends 114, 116 of the fuse body 112. In some exemplary, non-limiting embodiments, the trenches 134, 136 may have widths in a range of 0.15 millimeters-0.20 millimeters and may have depths in a range of 0.10 millimeters-0.15 millimeters. The trenches 134, 136 may have a semi-circular or rounded cross-sectional shape as shown in FIG. 1*a*, but this is not critical. The cross-sectional shape of one or both of the trenches 134, 136 may alternatively be rectangular, V-shaped, etc.

As shown in FIG. 1*a*, the solder fillets 130, 132 may include respective lip portions 146, 148 that extend into, and substantially fill, the trenches 134, 136, respectively. The lip portions 146, 148 may be formed during assembly of the fuse 100 when the solder fillets 130, 132 are in a fluid or semi-fluid state (e.g., before cooling/curing) and are compressed between the endcaps 118, 120 and the end faces 138, 140 of the fuse body 112, whereby the fluid or semi-fluid solder may flow into, and may conform to the shapes of, the trenches 134, 136.

Figure 1C:
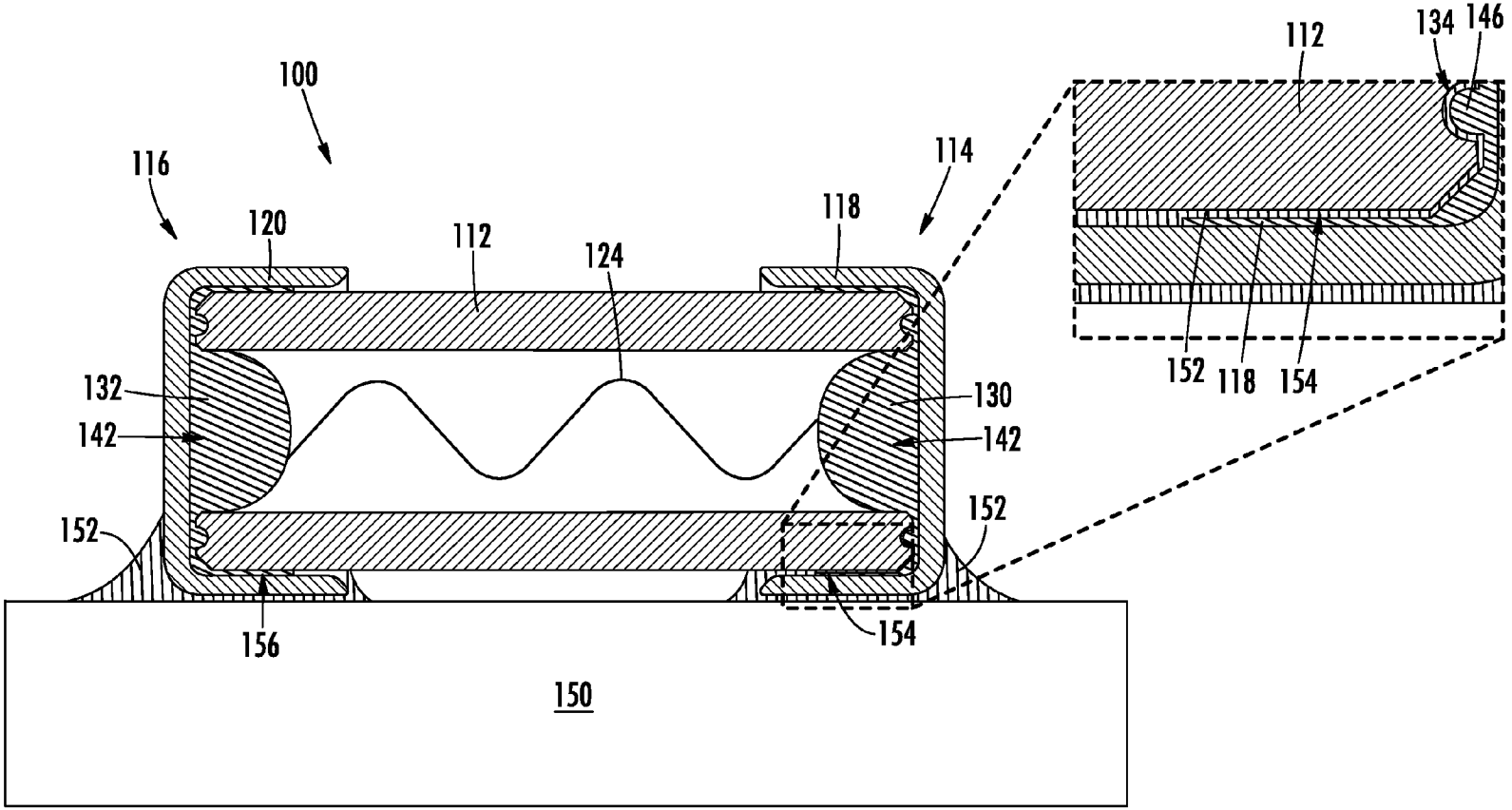
FIG. 1*c* is a cross sectional view illustrating the sealed fuse shown in FIG. 1*a* installed on a printed circuit board.

Referring now to FIG. 1*c*, a cross-sectional view of the fuse 100 soldered to a printed circuit board (PCB) 150 by quantities of solder 152 (hereinafter "the board solder 152") is shown. Heat from the application of the board solder 152 may cause the endcaps 118, 120 and the solder fillets 130, 132 to undergo thermal expansion at a rate greater than that of the fuse body 112. This occurs due to a mismatch between the coefficient of thermal expansion of the insulative fuse body 112 and the coefficients of thermal expansion of the conductive endcaps 118, 120 and solder fillets 130, 132. Thus, the heated endcaps 118, 120 and the solder fillets 130, 132 may expand away from the fuse body 112, resulting in the formation of gaps 154, 156 therebetween.

During application of the board solder 152 (i.e., while the board solder is in an uncured, fluid state), the board solder 152 may migrate through the gaps 154, 156 toward the end faces 138, 140 of the fuse body 112. Advantageously, the lip portions 146, 148 of the solder fillets 130, 132, which may also expand relative to the fuse body 112 as a result of heating from application of the board solder 152, remain disposed within the respective trenches 134, 136 in the fuse body 112 and provide barriers that firmly seal the gaps 154, 156 between the heated endcaps 118, 120 and the fuse body 112. Since these barriers entirely surround the openings 142, 144 of the fuse body 112, they (the barriers) may effectively prevent the ingress of the fluid or semi-fluid board solder 152 into the openings 142, 144 and hollow interior 125 of the fuse body 112 during installation of the fuse 100 on the PCB 150. Thus, degradation in the performance of the fuse 100 that might otherwise result from the migration of the board solder 152 into the fuse body 112 is mitigated or entirely prevented.

Figure 2:
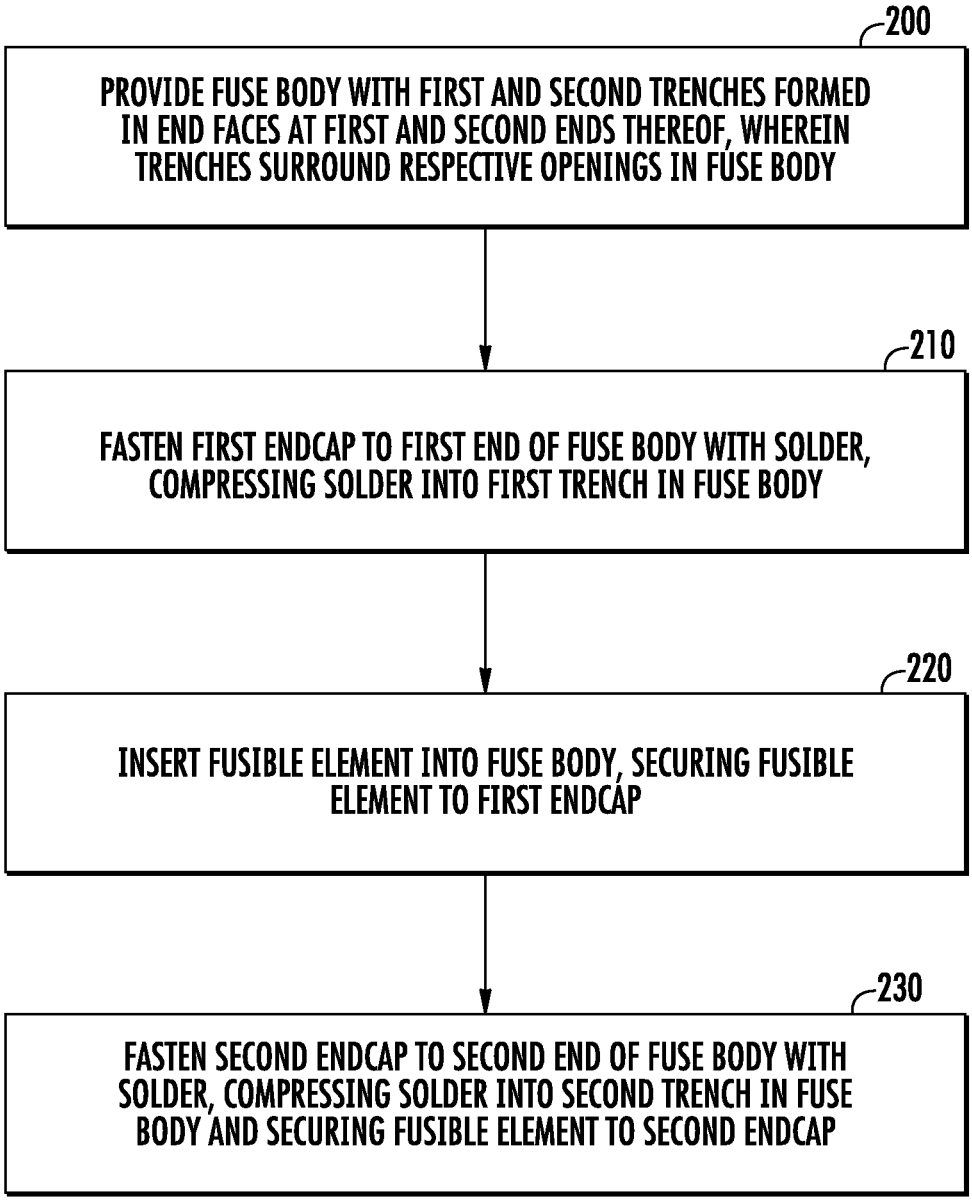
FIG. 2 is a flow diagram illustrating an exemplary method of manufacturing the sealed fuse shown in FIGS. 1*a*-1*c* in accordance with the present disclosure.

Referring to FIG. 2, a flow diagram illustrating an exemplary method for manufacturing the above-described fuse 100 in accordance with the present disclosure is shown. The method will now be described in conjunction with the illustrations of the fuse 100 shown in FIGS. 1*a*-1*c*.

At step 200 of the exemplary method, the tubular fuse body 112 having a hollow interior 125 and open ends 114, 116 may be provided. The fuse body 112 may have channels or trenches 134, 136 formed in longitudinal end faces 138, 140 thereof, respectively. The trenches 134, 136 may be continuous (i.e., without termini) and may entirely surround the openings 142, 144 in the respective open ends 114, 116 of the fuse body 112.

At step 210 of the exemplary method, the conductive endcap 118 may be fastened to the open end 114 of the fuse body 112 with the solder fillet 130 or, alternatively, by an electrically conductive adhesive that may be applied in a fluid or semi-fluid state. When the endcap 118 is pressed onto the open end 114 of the fuse body 112, the solder fillet 130, which may be in a fluid or semi-fluid state prior to curing or hardening, may be compressed between the endcap 118 and the end face 138 of the fuse body 112, whereby the fluid or semi-fluid solder may flow into, and may conform to the shape of, the trench 134, thereby forming a lip portion 146 that substantially fills the trench 134.

At step 220 of the exemplary method, the fusible element 124 may be inserted into the hollow interior 125 of the fuse body 112 and may be secured to the solder fillet 130 while the solder fillet 130 is still in a fluid or semi-fluid state, thereby placing the fusible element 124 in electrical communication with the endcap 118.

At step 230 of the exemplary method, the conductive endcap 120 may be fastened to the open end 116 of the fuse body 112 with the solder fillet 132 or, alternatively, by an electrically conductive adhesive that may be applied in a fluid or semi-fluid state. When the endcap 120 is pressed onto the open end 116 of the fuse body 112, the solder fillet 132, which may be in a fluid or semi-fluid state prior to curing or hardening, may be compressed between the endcap 120 and the end face 140 of the fuse body 112, whereby the fluid or semi-fluid solder may flow into, and may conform to the shape of, the trench 136, thereby forming a lip portion 148 that substantially fills the trench 136. The solder fillet 132 may also engage and form a connection with the free end of the fusible element 124, thereby placing the fusible element 124 in electrical communication with the endcap 120.

Figure 3A:
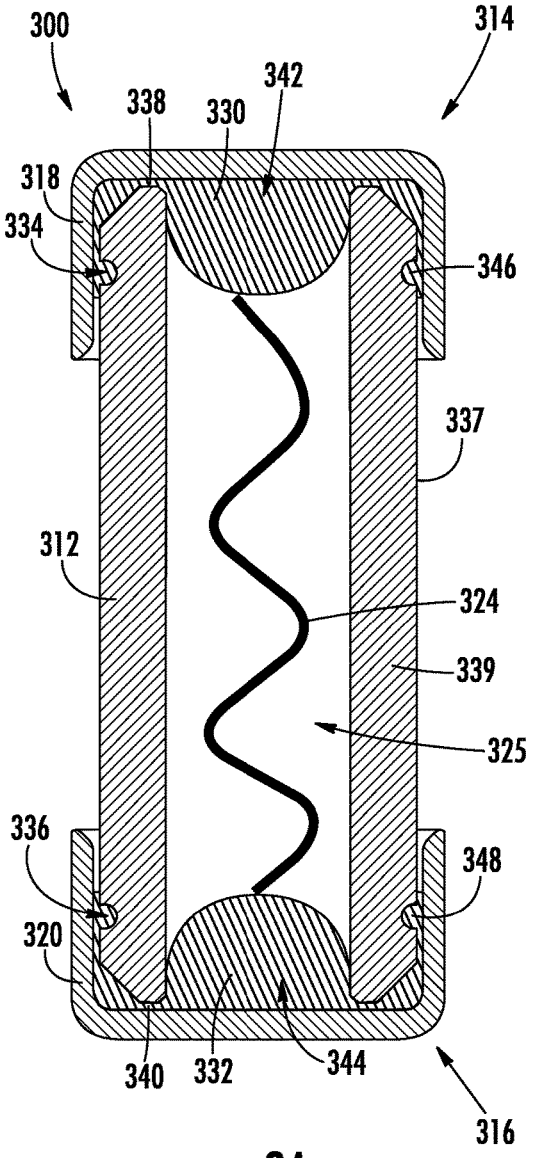
FIG. 3*a* is a cross sectional view illustrating an exemplary sealed fuse in accordance with the present disclosure.

Referring to FIG. 3*a*, a cross-sectional view of a sealed fuse 300 (hereinafter "the fuse 300") in accordance with another exemplary embodiment of the present disclosure is shown. The fuse 300 may be similar to the fuse 100 described above and may include a tubular fuse body 312 having opposing open ends 314, 316. The fuse body 312 may be a square cylinder (as shown in FIG. 2*b*), but this is not critical. Alternative embodiments of the fuse 300 may have a fuse body that is a round cylinder, an oval cylinder, a triangular cylinder, etc.

A pair of conductive endcaps 318, 320 may fit over the open ends 314, 316 of the fuse body 312, respectively, and may be fastened thereto by solder fillets 330, 332. Alternatively, and as will become apparent below, any type of electrically conductive adhesive that may be applied in a fluid or semi-fluid state and subsequently cured or hardened may be substituted for the solder fillets 330, 332. A fusible element 324 (e.g., a fuse wire) may extend through the hollow interior 325 of the fuse body 312 and may be secured to the endcaps 318, 320 in electrical communication therewith by the solder fillets 330, 332. Alternatively, one or both ends of the fusible element 324 may extend through respective holes in the endcaps 318, 320 and may be soldered to exterior faces of the endcaps 318, 320.

The fuse body 312 of the fuse 300 may be formed of an electrically insulating and preferably heat resistant material, including, but not limited to, ceramic or glass. The endcaps 318, 320 may be formed of an electrically conductive material, including, but not limited to, copper or one of its alloys, and may be plated with nickel or other conductive, corrosion resistant coatings. The fusible element 324 may be formed of an electrically conductive material, including, but not limited to, tin or copper, and may be configured to melt and separate upon the occurrence of a predetermined fault condition, such as an overcurrent condition in which an amount of current exceeding a predefined maximum current flows through the fusible element 324. The fusible element 324 may be any type of fusible element suitable for a desired application, including, but not limited to, a fuse wire, a corrugated strip, a fuse wire wound about an insulating core, etc. In some embodiments, the fusible element 324 may extend diagonally through the hollow interior 325 of the fuse body 312. In some embodiments the hollow interior 325 of the fuse body 312 may be partially or entirely filled with an arc-quenching material, including, but not limited to, sand, silica, etc.

Figure 3B:
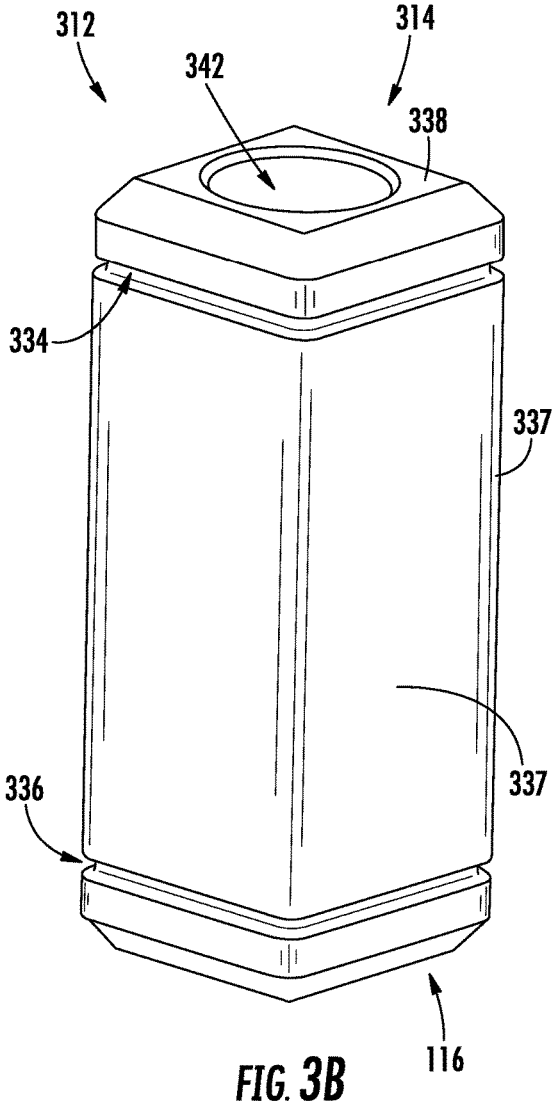
FIG. 3*b* is an isometric view illustrating a fuse body of the sealed fuse shown in FIG. 3*a;*

Referring to FIGS. 3*a* and 3*b*, the fuse body 312 may include channels or trenches 334, 336 formed in the outwardly-facing surface 337 of the sidewall 339 thereof (i.e., wherein the outwardly-facing surface 337 is parallel to a longitudinal axis of the fuse body 312) adjacent the opposing longitudinal ends of the fuse body 312, respectively, spaced longitudinally inward from the end faces 338, 340 but covered by the endcaps 318, 320. The trenches 334, 336 may be continuous (i.e., without termini), and may extend entirely around the fuse body 312. In some exemplary, non-limiting embodiments, the trenches 334, 336 may have widths in a range of 0.15 millimeters-0.20 millimeters and may have depths in a range of 0.10 millimeters-0.15 millimeters. The trenches 334, 336 may have a semi-circular or rounded cross-sectional shape as shown in FIG. 3*a*, but this is not critical. The cross-sectional shape of one or both of the trenches 334, 336 may alternatively be rectangular, V-shaped, etc.

As shown in FIG. 3*a*, the solder fillets 330, 332 may include respective lip portions 346, 348 that extend into, and substantially fill, the trenches 334, 336, respectively. The lip portions 346, 348 may be formed during assembly of the fuse 300 when the solder fillets 330, 332 are in a fluid or semi-fluid state (e.g., before cooling/curing) and are compressed between the endcaps 318, 320 and the outwardly-facing surface 337 of the sidewall 339, whereby the fluid or semi-fluid solder may flow into, and may conform to the shapes of, the trenches 334, 336.

Figure 3C:
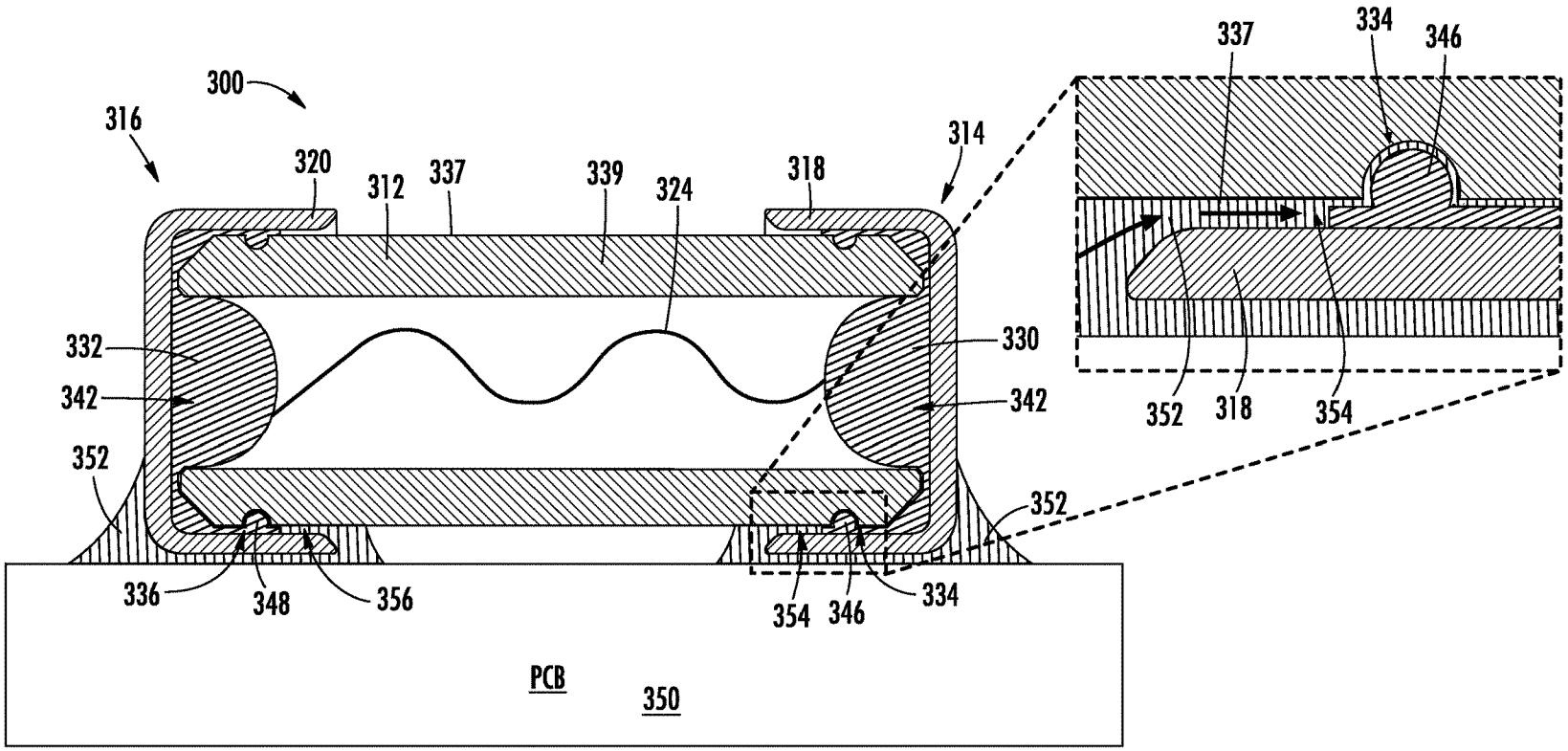
FIG. 3*c* is a cross sectional view illustrating the sealed fuse shown in FIG. 3*a* installed on a printed circuit board.

Referring now to FIG. 3*c*, a cross-sectional view of the fuse 300 soldered to a printed circuit board (PCB) 350 by quantities of solder 352 (hereinafter "the board solder 352") is shown. Heat from the application of the board solder 352 may cause the endcaps 318, 320 and the solder fillets 330, 332 to undergo thermal expansion at a rate greater than that of the fuse body 312. This occurs due to a mismatch between the coefficient of thermal expansion of the insulative fuse body 312 and the coefficients of thermal expansion of the conductive endcaps 318, 320 and solder fillets 330, 332. Thus, the heated endcaps 318, 320 and the solder fillets 330, 332 may expand away from the fuse body 312, resulting in the formation of gaps 354, 356 therebetween.

During application of the board solder 352 (i.e., while the board solder is in an uncured, fluid state), the board solder 352 may migrate through the gaps 354, 356 toward the end faces 338, 340 of the fuse body 312. Advantageously, the lip portions 346, 348 of the solder fillets 330, 332, which may also expand relative to the fuse body 312 as a result of heating from application of the board solder 352, remain disposed within the respective trenches 334, 336 in the fuse body 312 and provide barriers that firmly seal the gaps 354, 356 between the heated endcaps 318, 320 and the fuse body 312. Since these barriers extend entirely around the fuse body 312, they (the barriers) may effectively prevent the ingress of the fluid or semi-fluid board solder 352 into the open ends 314, 316 and hollow interior 325 of the fuse body 312 during installation of the fuse 300 on the PCB 350. Thus, degradation in the performance of the fuse 300 that might otherwise result from the migration of the board solder 352 into the fuse body 312 is mitigated or entirely prevented.

Figure 4:
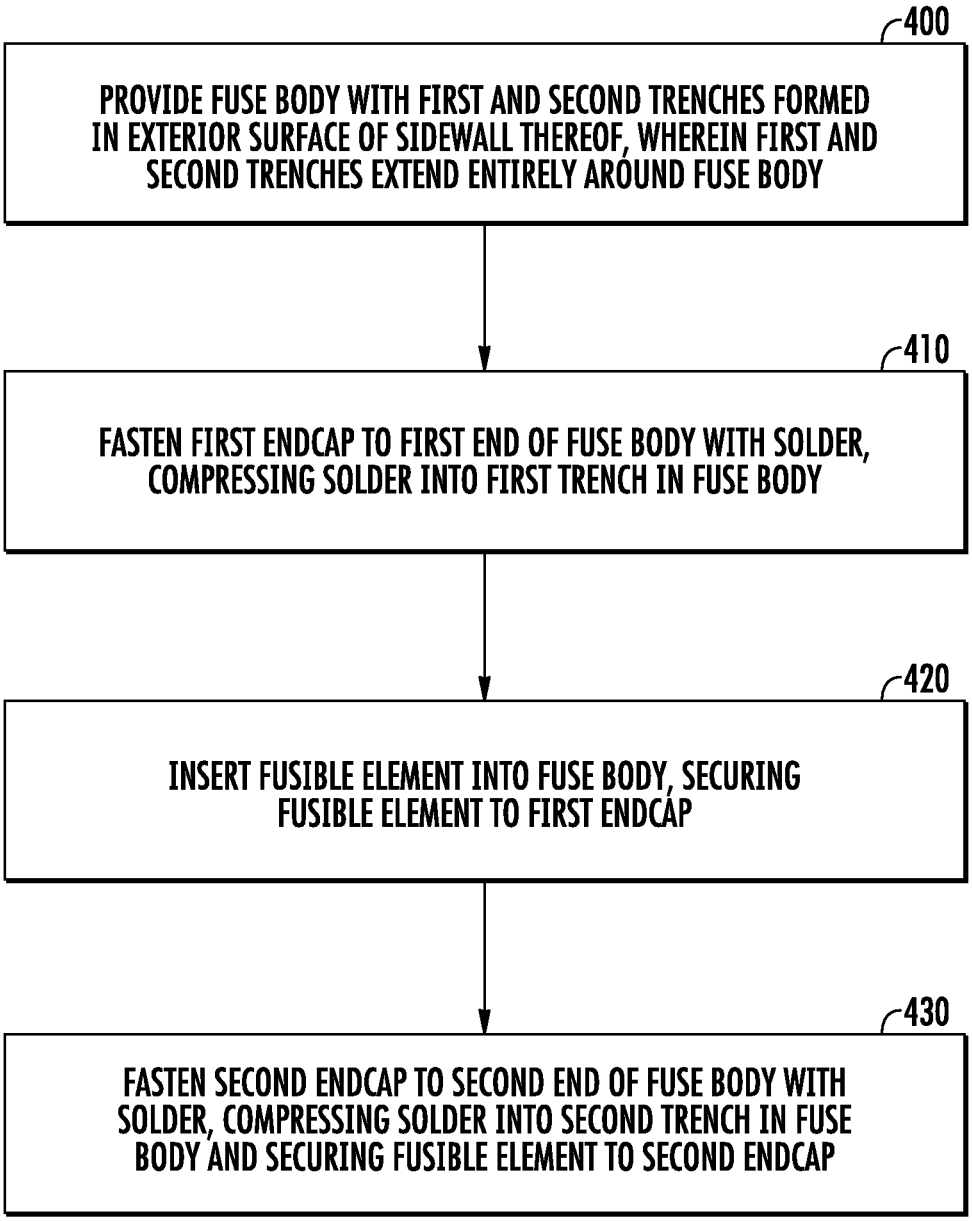
FIG. 4 is a flow diagram illustrating an exemplary method of manufacturing the sealed fuse shown in FIGS. 3*a*-3*c* in accordance with the present disclosure.

Referring to FIG. 4, a flow diagram illustrating an exemplary method for manufacturing the above-described fuse 300 in accordance with the present disclosure is shown. The method will now be described in conjunction with the illustrations of the fuse 300 shown in FIGS. 3*a*-3*c*.

At step 400 of the exemplary method, the tubular fuse body 312 having a hollow interior 325 and open ends 314, 316 may be provided. The fuse body 312 may have channels or trenches 334, 336 formed in the outwardly-facing surface 337 of the sidewall 339 thereof adjacent the opposing longitudinal ends of the fuse body 312, respectively, spaced longitudinally inward from the end faces 338, 340 of the fuse body 312. The trenches 334, 336 may be continuous (i.e., without termini) and may entirely surround the fuse body 312.

At step 410 of the exemplary method, the conductive endcap 318 may be fastened to the open end 314 of the fuse body 312 with the solder fillet 330 or, alternatively, by an electrically conductive adhesive that may be applied in a fluid or semi-fluid state. When the endcap 318 is pressed onto the open end 314 of the fuse body 312, the solder fillet 330, which may be in a fluid or semi-fluid state prior to curing or hardening, may be compressed between the endcap 318 and the outwardly-facing surface 337 of the sidewall 339, whereby the fluid or semi-fluid solder may flow into, and may conform to the shape of, the trench 334, thereby forming a lip portion 346 that substantially fills the trench 334.

At step 420 of the exemplary method, the fusible element 324 may be inserted into the hollow interior 325 of the fuse body 312 and may be secured to the solder fillet 330 while the solder fillet 330 is still in a fluid or semi-fluid state, thereby placing the fusible element 324 in electrical communication with the endcap 318.

At step 430 of the exemplary method, the conductive endcap 320 may be fastened to the open end 316 of the fuse body 312 with the solder fillet 332 or, alternatively, by an electrically conductive adhesive that may be applied in a fluid or semi-fluid state. When the endcap 320 is pressed onto the open end 316 of the fuse body 312, the solder fillet 332, which may be in a fluid or semi-fluid state prior to curing or hardening, may be compressed between the endcap 320 and the outwardly-facing surface 337 of the sidewall 339, whereby the fluid or semi-fluid solder may flow into, and may conform to the shape of, the trench 136, thereby forming a lip portion 348 that substantially fills the trench 336. The solder fillet 332 may also engage and form a connection with the free end of the fusible element 324, thereby placing the fusible element 324 in electrical communication with the endcap 320.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A sealed fuse comprising:

a tubular fuse body having opposing end faces and a sidewall extending between the end faces;

a trench formed in an exterior surface of the sidewall;

a fusible element disposed within the fuse body; and an electrically conductive endcap that fits over an end of the fuse body and is fastened to the fuse body by an electrically conductive material having a lip portion that extends into the trench to provide a barrier that extends between the fuse body and the endcap, wherein the trench extends entirely around the sidewall and is disposed entirely within the endcap.

2. The sealed fuse of claim 1, wherein the fuse body is formed of an electrically insulating material.

3. The sealed fuse of claim 1, wherein the conductive material is a material that can be applied in a fluid, first state and that can subsequently be hardened to second state that is relatively less fluid than the first state.

4. The sealed fuse of claim 1, wherein the conductive material comprises one of solder and a conductive adhesive.

5. The sealed fuse of claim 1, wherein the endcap is a first endcap, the trench is a first trench, and the conductive material is a first conductive material, the sealed fuse further comprising an electrically conductive second endcap that fits over an end of the fuse body opposite the first endcap and is fastened to the fuse body by a second conductive material having a lip portion that extends into a second trench in the exterior of the fuse body to provide a barrier extending between the fuse body and the second endcap.

6. The sealed fuse of claim 5, wherein the fusible element extends through the fuse body and is secured to the first conductive material and to the second conductive material and provides an electrically conductive pathway between the first endcap and the second endcap.

7. A method of manufacturing a sealed fuse, the method comprising:

providing a tubular fuse body having opposing end faces and a sidewall extending between the end faces, a trench formed in an exterior of the sidewall; and fastening an electrically conductive endcap to an end of the fuse body with an electrically conductive material that forms a lip portion that extends into the trench to provide a barrier that extends between the fuse body and the endcap, wherein the trench extends entirely around the sidewall and is disposed entirely within the endcap.

8. The method of claim 7, wherein the fuse body is formed of an electrically insulating material.

9. The method of claim 7, wherein, when the endcap is fastened to the end of the fuse body, the conductive material is in a fluid, first state and flows into the trench as the conductive material is compressed between the endcap and the exterior of the fuse body, and wherein the conductive material subsequently hardens to a second state that is less fluid than the first state.

10. The method of claim 7, wherein the conductive material comprises one of solder and a conductive adhesive.

11. The method of claim 7, wherein the endcap is a first endcap, the trench is a first trench, and the conductive material is a first conductive material, the method further comprising fastening an electrically conductive second endcap over an end of the fuse body opposite the first endcap by a second conductive material that forms a lip portion that extends into a second trench in the exterior of the fuse body to provide a barrier extending between the fuse body and the second endcap.

12. The method of claim 11, further comprising inserting a fusible element into the fuse body and securing the fusible element to the first conductive material and to the second conductive material to provide an electrically conductive pathway between the first endcap and the second endcap.

* * * * *